US010330385B2

(12) United States Patent
Caspers et al.

(10) Patent No.: US 10,330,385 B2
(45) Date of Patent: Jun. 25, 2019

(54) FLUIDIZED-BED VAPORISATION DRYER

(71) Applicant: BMA BRAUNSCHWEIGISCHE MASCHINENBAUANSTALT AG, Braunschweig (DE)

(72) Inventors: Gerald Caspers, Meine (DE); Hartmut Hafemann, Lehrte (DE); Carsten Bonath, Braunschweig (DE); Holger Fersterra, Braunschweig (DE)

(73) Assignee: BMA BRAUNSCHWEIGISCHE MASCHINENBAUANSTALT AG, Braunschweig (DE)

( * ) Notice: Subject to any disclaimer, the term of this patent is extended or adjusted under 35 U.S.C. 154(b) by 341 days.

(21) Appl. No.: 15/307,716

(22) PCT Filed: Mar. 9, 2015

(86) PCT No.: PCT/IB2015/051707
§ 371 (c)(1),
(2) Date: Oct. 28, 2016

(87) PCT Pub. No.: WO2015/166358
PCT Pub. Date: Nov. 5, 2015

(65) Prior Publication Data

US 2017/0045293 A1 Feb. 16, 2017

(30) Foreign Application Priority Data

Apr. 30, 2014 (DE) ..... 10 2014 106 122

(51) Int. Cl.
*F26B 3/08* (2006.01)
*F26B 17/10* (2006.01)
*F26B 25/00* (2006.01)

(52) U.S. Cl.
CPC ..... *F26B 17/107* (2013.01); *F26B 17/10* (2013.01); *F26B 17/103* (2013.01); *F26B 25/007* (2013.01)

(58) Field of Classification Search
CPC .... F26B 3/06; F26B 3/08; F26B 3/084; F26B 3/10
(Continued)

(56) References Cited

U.S. PATENT DOCUMENTS 4,324,544 A * 4/1982 Blake ..... F26B 3/08 110/245
5,357,686 A * 10/1994 Jensen ..... F26B 17/10 34/169
(Continued)

FOREIGN PATENT DOCUMENTS

EP 1070223 B1 2/2005

OTHER PUBLICATIONS

International Search Report for PCT/IB2015/051707 dated May 20, 2015.
(Continued)

*Primary Examiner* — John P McCormack
(74) *Attorney, Agent, or Firm* — Jones Day

(57) ABSTRACT

The present invention relates to a device for removing fluids and/or solid substances from a mixture of particle-shaped materials with a container which forms a ring-shaped process chamber with a plurality of cells separated from each other by walls, comprising an inlet cell, intermediate cells and an outlet cell, a feeding installation for conveying the mixture to be treated into the inlet cell of the process chamber, a discharge installation for discharging the mixture treated from the outlet cell of the process chamber, a ventilation installation for feeding in a first fluidisation agent, in particular in the form of overheated vapour, from
(Continued)

below into the process chamber through an inflow floor for generating a fluidised bed in the process chamber, a heating installation for preparing the first fluidisation agent in the flow direction before the ventilation installation, swirl impellers for conditioning the flow in the container from the process chamber to the heating installation and which in part also leads to a vapour outlet, and a dust removal installation in the flow path between the process chamber and the heating installation, wherein dust can be guided to the outlet cell via the dust removal installation, wherein in order to support a transportation of the mixture from the inlet cell to the outlet cell and/or a turbulence of the mixture in the process chamber, the inflow floor comprises first unevenness and/or at least at times a second fluidisation agent, in particular in the form of overheated vapour, can be fed at least into the inlet cell essentially parallel to the inflow floor by means of first nozzles, and/or first flow guidance members are provided above the inflow floor and/or second flow guidance members are provided below the inflow floor.

16 Claims, 10 Drawing Sheets

(58) Field of Classification Search
USPC ..... 34/359, 360, 363, 370, 576, 589, 590
See application file for complete search history.

(56) References Cited

U.S. PATENT DOCUMENTS 6,096,839 A * 8/2000 Chinh ..... B01J 8/1827 526/68
2003/0190417 A1* 10/2003 Takei ..... B01J 2/006 427/213
2012/0258029 A1* 10/2012 Krutka ..... B01D 53/12 423/210

OTHER PUBLICATIONS

Written Opinion of the International Searching Authority for PCT/IB2015/051707.

* cited by examiner

FLUIDIZED-BED VAPORISATION DRYER

CROSS-REFERENCE TO RELATED APPLICATIONS

This application is a national stage entry of International Patent Application No. PCT/IB2015/051707, filed Mar. 9, 2015, which claims the benefit of German Patent Application No. DE 102014106122.5, filed Apr. 30, 2014, the disclosures of each of which is incorporated herein by reference in their entirety.

STATEMENT REGARDING FEDERALLY SPONSORED RESEARCH OR DEVELOPMENT

Not applicable.

REFERENCE TO COMPACT DISK APPENDIX

Not applicable.

BACKGROUND OF THE INVENTION

1. Field of the Invention

The invention relates to a device for removing fluids and/or solid substances from a mixture of particle-shaped materials. For example, the device removes fluids and/or solid substances from a mixture of particle-shaped materials with a container which forms a ring-shaped process chamber with a plurality of cells separated from each other by walls, comprising an inlet cell, intermediate cells and an outlet cell, a feeding installation for conveying the mixture to be treated into the inlet cell of the process chamber, a discharge installation for discharging the mixture treated from the outlet cell of the process chamber, a ventilation installation for feeding in a first fluidisation agent, in particular in the form of overheated vapour, from below into the process chamber through an inflow floor for generating a fluidised bed in the process chamber, a heating installation for preparing the first fluidisation agent in the flow direction before the ventilation installation, swirl impellers for conditioning the flow in the container from the process chamber to the heating installation and which in part also leads to a vapour outlet, and a dust removal installation in the flow path between the process chamber and the heating installation, wherein dust can be guided to the outlet cell via the dust removal installation. A device of this type is in particular suitable for drying bulk products and materials from the food and animal feed industry, although other particle-shaped materials or mixtures from them can also be treated with such a device.

2. Description of Related Art

A plurality of devices of the above-named type are known from the prior art, which generally use overheated vapour as a fluidisation agent. These so-called "fluidised bed vaporisation dryers" are used to charge overheated vapour through bulk products or particle-shaped materials from below and to fluidise them, so that a fluidised bed is created. The material to be treated is here transported from an entry cell in which the material to be treated is introduced into the container and the process chamber, via subsequent method cells through to a discharge cell. In the discharge cell, no inflow occurs from below, so that on the lower end of the discharge cell, the material that has been fully treated can be discharged, for example via a discharge screw conveyor. The container is sealed on the discharge end and on the feeding installation by means of a threshold installation in order to be able to allow the processing sequence to run under overpressure. Particles which are carried along by the vapour are separated on the path from the process chamber to a (vapour) outlet using impellers which generate a swirl and a dust removal installation, in order to then guide the vapour which has been freed of dust to the process chamber following renewed heating in a heating installation via an inflow floor. Such installations are known e.g. from EP 1 956 326 B 1, EP 2 146 167 BI, EP 1 070 223 B1, U.S. Pat. No. 5,357,686 and EP 2 457 649 AI.

With the known devices, impermissible material accumulations or lumps may occur in the area of the material charge, which in the worst case can lead to a total failure of the device. In order to remedy a blockage in the process chamber, the device must namely be switched off, rendered pressureless, and cooled down in order to then manually remove the blockage with impellers or similar.

SUMMARY

The object of the invention is thus to further develop the generic device in such a manner that it comprises a higher degree of operational reliability. In particular, the creation of lumps of drying products, i.e. the mixture of particle-shaped materials, is to be fundamentally avoided. The through-flow of the device overall is therefore to be improved.

This object is attained according to the invention by means of the fact that in order to support a transportation of the mixture from the inlet cell to the outlet cell and/or a turbulence of the mixture in the process chamber, the inflow floor comprises first unevenness and/or at least at times a second fluidisation agent, in particular in the form of overheated vapour, can be fed at least into the inlet cell essentially parallel to the inflow floor by means of first nozzles, and/or first flow guidance members are provided above the inflow floor and/or second flow guidance members are provided below the inflow floor.

Here it can be provided that in the inlet cell, a mixing of dried and damp parts of the mixture takes place according to a type of stirrer tank, in the intermediate cells a flow guidance according to a type of flow pipe is realised in order to avoid the mixing of damp parts with dried parts of the mixture, and no fluidisation agent penetrates into the outlet cell through the inflow floor.

It is also recommended that the feeding installation for the mixture is connected with the container in the area of the outlet cell, preferably in the centre of the height of the inlet cell and/or at the level of the upper outlets of the fluidised bed.

Here it can be provided that the feeding installation guides the loosened mixture to the inlet cell via a mechanical transport means, preferably by means of mechanically acting paddles, in particular of a screw conveyor, and/or pre-warmed and/or via air transport, preferably by adding a third fluidisation agent, in particular in the form of overheated vapour through vapour injection into the screw conveyor.

It is preferred that the area of the inflow floor is larger in the inlet cell, preferably doubly the size, of the respective area of the inflow floor of the intermediate cells.

It is further preferred that the inflow floor comprises first openings in the inlet cell and in the intermediate cells, the opening relationship of which preferably decreases from the inlet cell in the direction of the outlet cell.

Devices according to the invention can be characterized by the fact that the inflow floor comprises the first unevenness in the form of deeper lying recesses and/or at least over the first quarter of the process chamber.

It is additionally recommended that the inflow floor points upwards on its edge facing towards the container, and otherwise runs essentially horizontally, wherein the edge is preferably equipped with first openings and/or first unevenness at least over the first quarter of the process chamber.

It can also be provided that the second fluidisation agent can be fed in with a pressure of at least 2 bar above the average pressure in the container and/or in the first quarter of the process chamber.

A screen for the heating installation can be provided, wherein preferably, the screen widens conically in the process chamber from top to bottom, the first nozzles extend between the screen and the inflow floor, and/or the screen comprises two openings and/or second unevenness, preferably in the form of deeper lying recesses.

It is also recommended that the wall between the outlet cell and the inlet cell extends up to the height of the inflow floor, and/or the walls between the inlet cell and a first intermediate cell, between the intermediate cells and between the first intermediate cell and the outlet cell, comprise a vertical distance to the inflow floor, in particular to the edge of the inflow floor.

It is preferred that the first flow guidance members are provided and/or adjustable between the first nozzles.

With the invention, it is further recommended that first second flow guidance members are provided in a torospherical head as part of a discharge guide vane of the ventilation installation, wherein preferably, the ventilation installation comprises a bellows within the discharge guide vane.

Preferred devices according to the invention are characterized by the fact that second second flow guidance members are provided in a torospherical head and/or are attached and/or adjustable on the discharge guide vane, preferably in each case pivoted around a pivot axis which is essentially vertical to the inflow floor or which extends vertically.

It is equally preferred that third second flow guidance members are attached and/or adjustable on inflow floor supporting members, preferably in each case pivoted around a pivot axis which is essentially parallel to the inflow floor or which extends horizontally.

According to the invention, it is also recommended that the number, alignment and/or arrangement of the first and/or second openings, the first and/or second unevenness, the first nozzles and/or the first and/or second flow guidance members is or are determined or changeable for the targeted appliance to the mixture with horizontal transport impulses in the direction of the outlet cell and/or turbulence impulses.

Here it can be provided that the alignment, in particular of the second second and/or third second flow guidance members, and/or the infeed from the second fluidisation agent to the first nozzles via an adjustment installation which can be operated from outside of the container, is changeable.

BRIEF DESCRIPTION OF THE SEVERAL VIEWS OF THE DRAWINGS

Further features and advantages of the invention arise from the following description, in which exemplary embodiments of the invention are explained in detail with reference to schematic drawings, in which.

DETAILED DESCRIPTION OF THE INVENTION

Figure 1A:
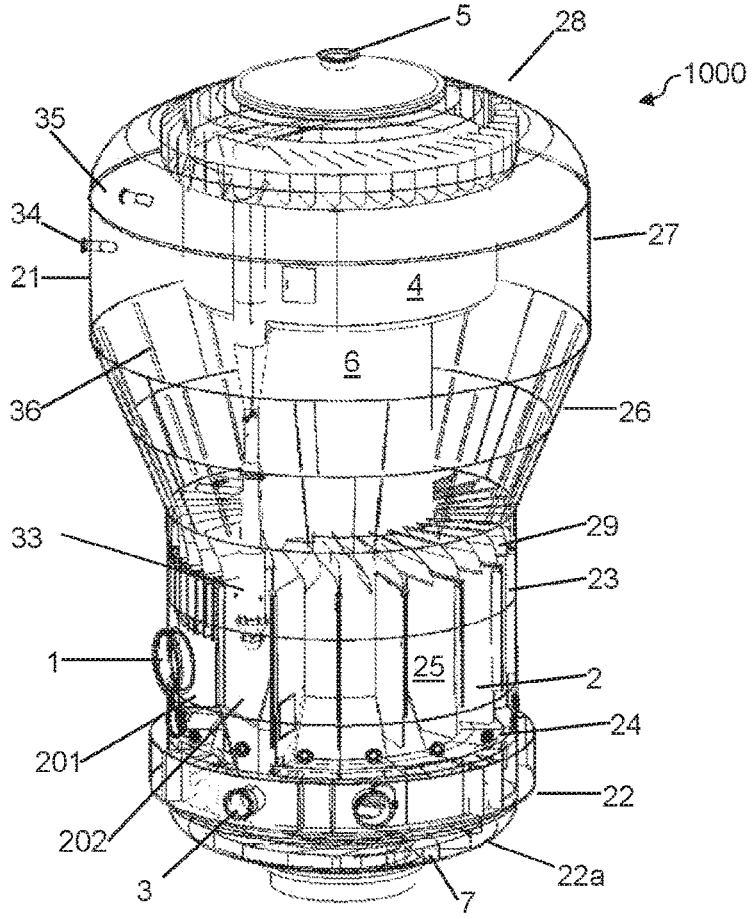
FIG. 1*a* shows a perspective side view of a first exemplary embodiment of a device according to the invention.
Figure 1B:
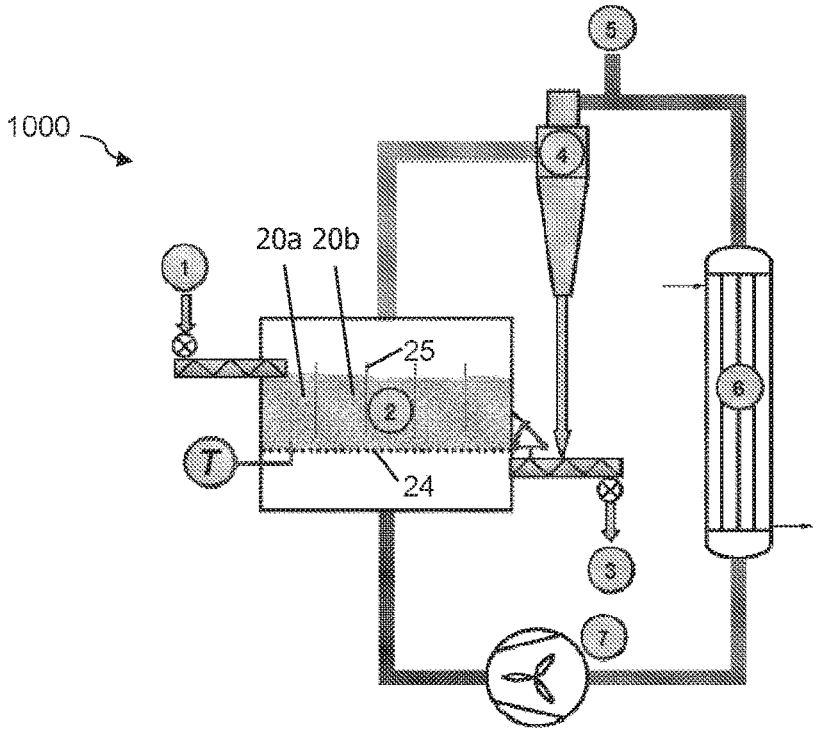
FIG. 1*b* shows a schematic view of the device as shown in FIG. 1*a;*

FIGS. 1*a* and 1*b* show a device according to the invention in the form of a fluidised bed vaporisation dryer 1000 with a feeding installation 1 for feeding products to be dried in the form of pressed pulp into a container 21, which comprises a process chamber 23 in the area of its floor 22. More precisely, the pulp is introduced into the process chamber 23 in which a fluidised bed 2 can be generated by charging overheated vapour through an inflow floor 24 in order to dry the pulp. Dried pulp can then be discharged from the container 21 by means of a discharge installation 3, while particles which are carried along by the vapour from the process chamber 23 are separated within the container 21, e.g. by means of a dust collector 4 above the fluidised bed 2. The vapour freed of particles then partially reaches a vapour outlet 5 and partially a heating installation, in order to again be heated by means of a heater 6, so that it can again be guided to the process chamber 23 through the inflow floor 24 with the interposition of a ventilation installation or a bellows 7. As a result, a closed circuit for part of the vapour is provided.

Above the inflow floor 24, walls 25 are arranged in a vertical alignment and essentially extend from an outer wall of the heater 6 to a wall of the container 21 in order to form cells between them in the process chamber 23. The walls 25 can reach down to the inflow floor 24, but must then comprise openings or form an empty space between themselves and the inflow floor 24. The cells formed by the walls 25 are open above, so that the vapour which serves as a first or second fluidisation agents 20*a*, 20*b* flow from bottom to top through the cells and carry material or particles to be treated, and if necessary transport them to a subordinate cell.

A first swirl is generated between the process chamber 23 and an extension cone 26 using impellers 29 above the walls 25. As a result, the vertical flow of the vapour is deflected in the process chamber 23 in order to lead to a swirl flow in the extension cone 26. Through the application of the swirl, the vapour together with the particles carried along with it is thus directed onto the wall of the container 21, as a result of which the particles are decelerated, namely through wall friction, so that the decelerated particles then fall back along the wall into the process chamber 23.

In the extension cone 26, a reduction of the flow velocity occurs, which leads to an expansion of the vapour flow out of the cells. The extension cone 26 and an upper area 27 which is adjacent to said cone comprise no fixtures, and are thus an empty space in which while separating the particles the flows from the cells split and at least partially mix with each other. In order to transmit kinetic energy for the purpose of improving the mixture of flow layers with different thermal states, overheated vapour is blown into the upper area 27 via nozzles 34 and 35. Separated particles are vertically conducted away along the wall in the extension cone 26 via ribs 36, while the remainder of the particles together with the vapour enters a central separator in the form of a dust collector 4 in the lid 28 of the container. The ribs 36 here ensure a deceleration of the particles, which facilitates separation. The inner contour of the lid 28 is formed to deflect the flow.

Following the preliminary separation of particles in the empty space, smaller particles are separated by the inflow of the particle-vapour mixture into the dust collector 4. The separated dust then enters an outlet cell 202 in the process chamber 23 via a dust cyclone 33.

The feeding installation 1 enters the pulp to be treated into a first cell in the process chamber 23, which is referred to below as the inlet cell 201. The first or second fluidisation agents 20*a*, 20*b* do not, or only to a low degree, flow through the last cell equipped with the discharge installation 3 or outlet cell 202, so that material entering into this cell 202 from above or on the inflow floor 24 lands in the floor area and can be removed via the discharge installation 3, in particular such as that described in EP 2 146 167 B1. One or more intermediate cells 203 are positioned between the inlet cell 201 and the outlet cell 202. In order to guarantee an even and constant fluidisation in the fluidised bed 2, a process control can be used in accordance with EP 2 457 649 A1.

Figure 2:
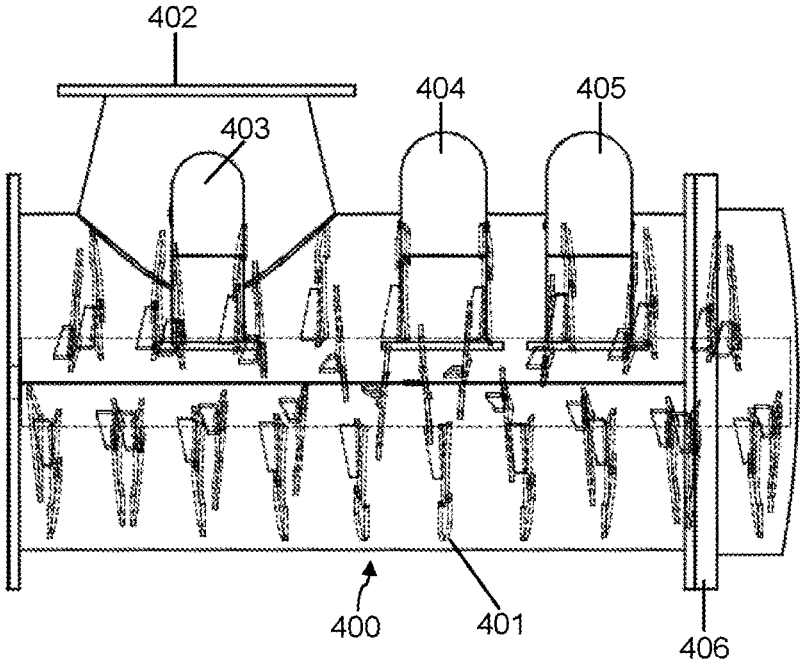
FIG. 2 shows a longitudinal profile view of a feeding installation of the device as shown in FIG. 1*a;*

The feeding installation 1 is arranged in such a manner that it enters the pulp into the centre of the inlet cell 201, at the level of the upper extensions of the fluidised bed 2, which provides a lower installation site than with known devices. Additionally, it ensures that the pulp reaches the inlet cell 201 in a loosened and pre-heated state. For this purpose, it comprises a screw conveyor 400 with rotatable paddles 401, as is shown in FIG. 2. In a feed area 402, wet product, i.e. pulp to be dried, is added and directly treated with vapour from a first vapour feed 403, and lumpy pulp is shredded by the mechanical energy input of the rotating paddles 401. By rotating the paddles 401, the pulp is also transported, however, and during transport is again treated with vapour from the second vapour feeds 404 and 405. Through a suitable feed of steam, in the feed area 402 and during the subsequent shredding of lumpy pulp during transport, not only a heating of the pulp under water vapour occurs, but also at the same time turbulences are created, which is why a swirl is indeed also present there. Through the mechanical transportation by means of the mechanically acting paddles 401 and the pre-heating and air transport by means of the vapour feed 403-405, the pulp reaches the process chamber 23 in a loosened and pre-heated state, which counteracts the formation of further lumps of pulp in the process chamber 23. This enables a blockage of openings, gaps and similar to be avoided in the process chamber 23, and secures a continuous transport of pulp from the inlet cell 201 to the outlet cell 202.

The screw conveyor 400 is attached to the container 21 via a docking area 406, and ensures that the pulp is introduced into the inlet cell 201 in a pre-heated and loosened state together with an excess quantity of steam, which immediately escapes upwards in the container 21. The inlet cell 201 preferably covers over a larger area of the inflow floor 24 than each of the remaining cells, so that the pulp which has been fed in is brought into contact with an enlarged floor area with an enlarge quantity of steam, which also again counteracts the formation of lumps. In the inlet cell 201, the pulp is namely still in its dampest state. A doubling of the size of the inlet cell 201 as opposed to the remaining cells has been shown to be particularly advantageous.

The flow from the inlet cell 201 to the outlet cell 202 is conditioned via a plurality of flow guidance members in order to further counteract the formation of lumps, as is described below with reference to FIGS. 3*a* to 3*c*, 4*a* and 4*b*.

Figure 3A:
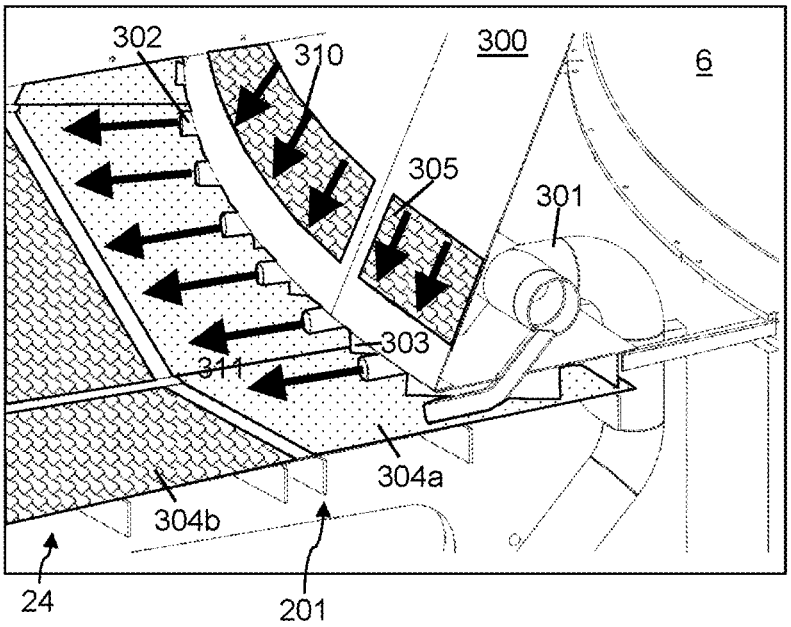
FIGS. 3*a*, 3*b*, and 3*c* show perspective partial views of the floor area of the device as shown in FIG. 1*a;*

A screen 300, also referred to hereinafter as an apron 300, limits the ring-shaped process chamber 23 inwards. Between the apron 300 and the heater 6, a vapour feed pipe 301 opens out above the inflow floor 24, in order to guide vapour in a transverse direction across the inflow floor 24 via first nozzles 302 to at least one first quarter of the cells, as is shown in FIG. 3*a*. This leads to a flow from the apron 300 radially to the wall of the container 21, see flow lines 311. Here, the vapour feed pipe 301 is arranged in the ring section of the inlet cell 201, in order to ensure additional loosening with transverse directed steam, since there, the pulp also still carries the largest water quantity with it. Additionally, guide plates 303 are arranged between the first nozzles 302 in order to guarantee the transverse flow in each cell. The first nozzles 302 and the guide plates 303 are thus flow guidance members, wherein the vapour feed via the first nozzles 302 additionally leads to a heating and water evaporation from the pulp.

Figure 3B:
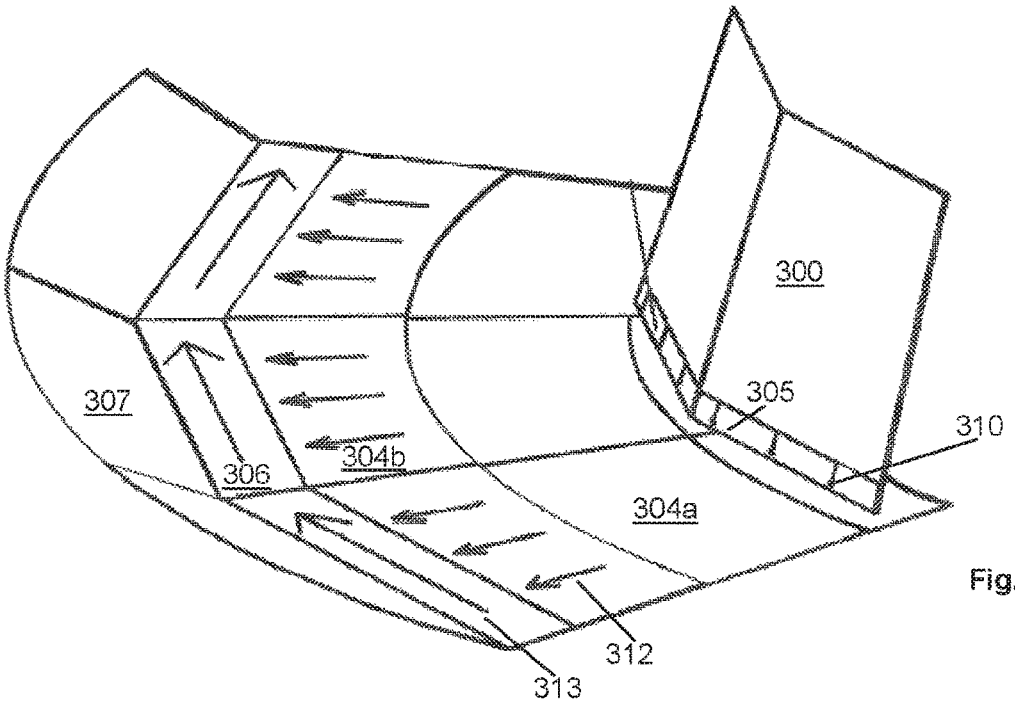
Figure 3C:
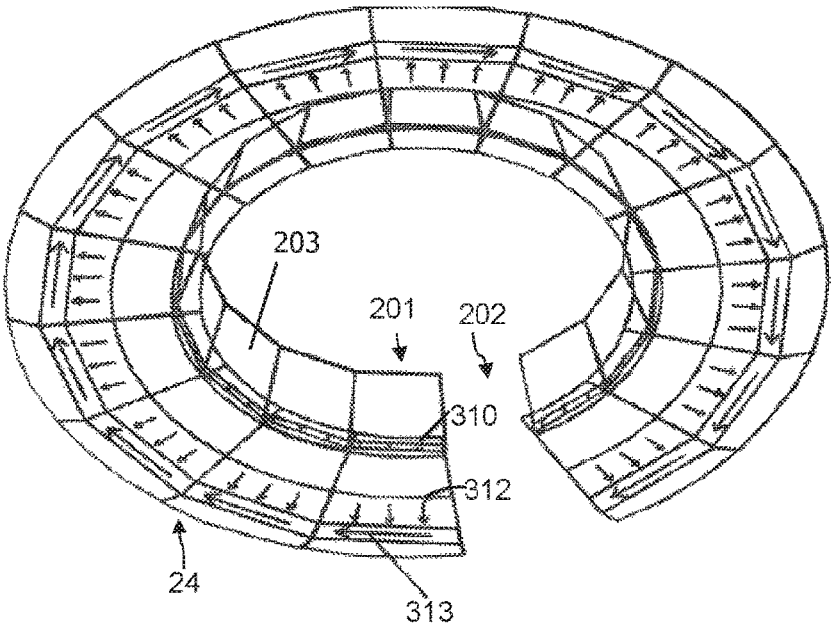

The inflow floor 24 and the apron 300 are designed with perforated sheets 304*a*, 304*b* and 305, in order to guide the flow in a targeted way. All perforated sheets 304*a*, 304*b* and 305 here comprise holes for a penetration of overheated steam, while some of these perforated sheets, namely perforated sheets 304*b* and 305, also comprise unevenness to guide said steam. As a result, the perforated sheets 305 of the apron 300 support a flow along the apron down to the inflow floor 24, see the flow lines 310, while the perforated sheets 304*b* support a flow along the flow lines 312 as an extension of the flow line 311, so that a circular flow is enforced in the fluidised bed 2 essentially vertical to the inflow floor 24, namely from the apron 300 via the inflow floor 24 back to the apron 300. A further circular flow of the same rotational direction is enforced by perforated sheets (not shown) with unevenness in a floor extension which inclines upwards in the direction of the open ends of the cells, which represents an edge 307 which is in contact with the wall of the container 21 as shown in FIG. 3*b*, namely along the inflow floor 24, the edge 307 and the wall back to the inflow floor 24.

Between the perforated sheet 304*b* and the edge 307 and thus between the two vertical circular flows in the same direction, a transportation area 306 runs which secures a horizontal circular path from the inlet cell 201 to the outlet cell 202 to convey the pulp in the process chamber 23. According to the invention, therefore, an uninterrupted transportation path of the pulp in the process chamber 23 is provided by applying horizontal transport impulses in the direction of the discharge area, see flow lines 313, while at least via the first quarter of the process chamber 23 a swirl is enforced with 2 swirls per cell circulating in the same direction, which homogenises the material flow in the process chamber 23 and improves the drying.

The nozzles 302, guide plates 303 and perforated sheets 304*a*, 304*b* and 305, can differ for each cell in order to take into account the progressive drying of the pulp. Thus the opening relationship of the perforated sheets 304*a* to 305 decreases in size from the inlet cell 201 to the outlet cell 202.

Figure 4A:
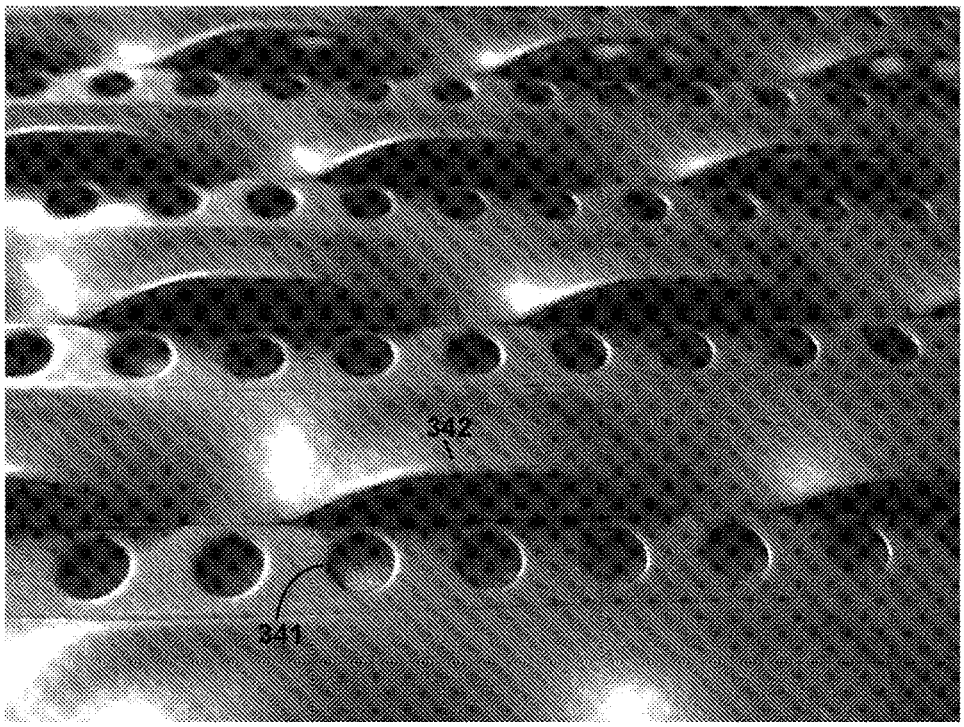
FIGS. 4*a* and 4*b* show perspective partial views of the underside and upper side of a perforated sheet with scales for the device as shown in FIGS. 1*a* and 1*b;*
Figure 4B:
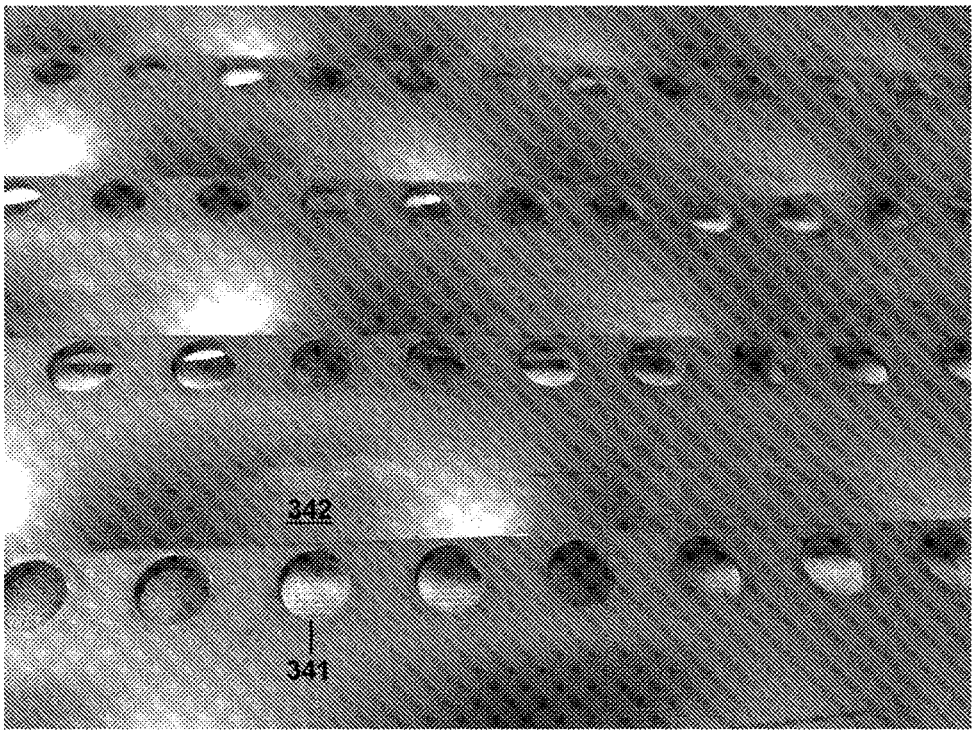

FIGS. 4*a* and 4*b* show as an example a perforated sheet 304*b* which comprises a plurality of second openings 341, also referred to hereinafter as holes 341, and second unevenness 342, also referred to hereinafter as scales 342. More precisely, FIG. 4*a* shows an underside 343 on which the perforated sheet 403*b* comprises one large opening for overheated vapour respectively in the area of the scales 342, which leads into an unevenness on the upper side 304, which is shown in FIG. 4*b*, and thus can apply a direction impulse to the overheated steam. Many different geometric designs are possible; equally, it is possible that the flow lines 312 shown in FIGS. 3*b* and 3*c* do not run precisely radially, but instead are inclined in the direction of the flow lines 313 in order to thus serve a transportation of the pulp.

The ventilator 7, which as shown in FIG. 1*a* is provided within a torospherical head 22*a* of the floor 22, serves to convey overheated vapour current from the heater 6, which is frequently also described as exhaust vapour, and which enables the fluidisation of the fluidised bed 2. The need for exhaust vapour current or drying exhaust vapour in the individual cells of the process chamber 23 differs, since the pulp to be dried loses humidity from the inlet cell 201 in the direction of the outlet cell 202. Since via the bellows 7 the exhaust vapour current enters the individual cells via the inflow floor 24 essentially parallel, the exhaust vapours are distributed according to the pressure loss which arises when the individual cells are subjected to the flow. This pressure loss is predominantly influenced by the pressure loss of the inflow floor 24 and the mass of the fluidised bed 2 located above it.

The pulp must not only be dried in the process chamber 21, but for drying purposes, it must at the same time also be transported from the inlet cell 201 to the outlet cell 202. With the exemplary embodiment shown in FIGS. 3*a*-3*d*, through targeted selection of the number, alignment and/or arrangement of the holes 341, the scales 342, the nozzles 302 and the guide plates 303, both the transportation and the swirl, and thus the drying, can be influenced here. The holes 341 and scales 342 in the perforated sheets 304*a*, 304*b* and 305, as well as the guide plates 303, are firmly installed in the fluidised bed vaporisation dryer 1000. An alternative structure in this regard is now described below with reference to FIGS. 5*a*-5*d*.

Figure 5A:
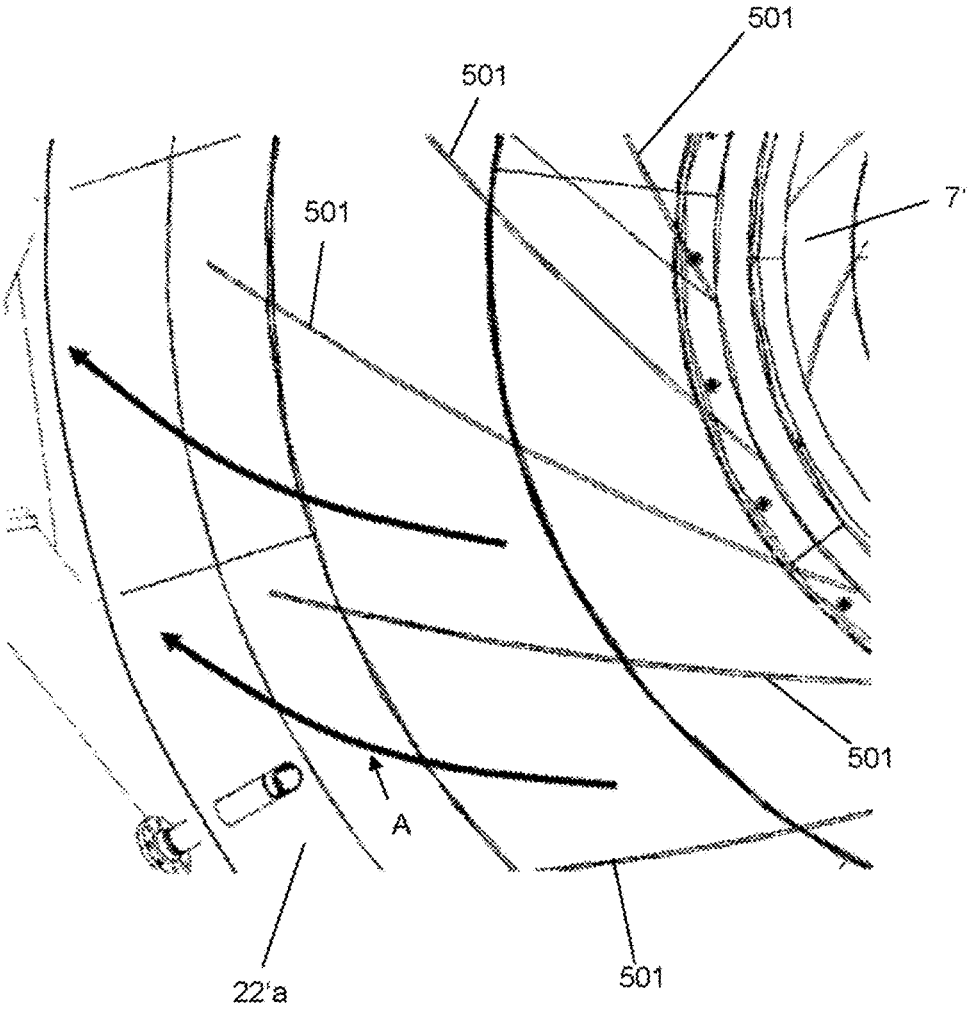
FIG. 5*a* shows a top view onto a floor area of a second exemplary embodiment of the device according to the invention with a discharge guide vane.
Figure 5B:
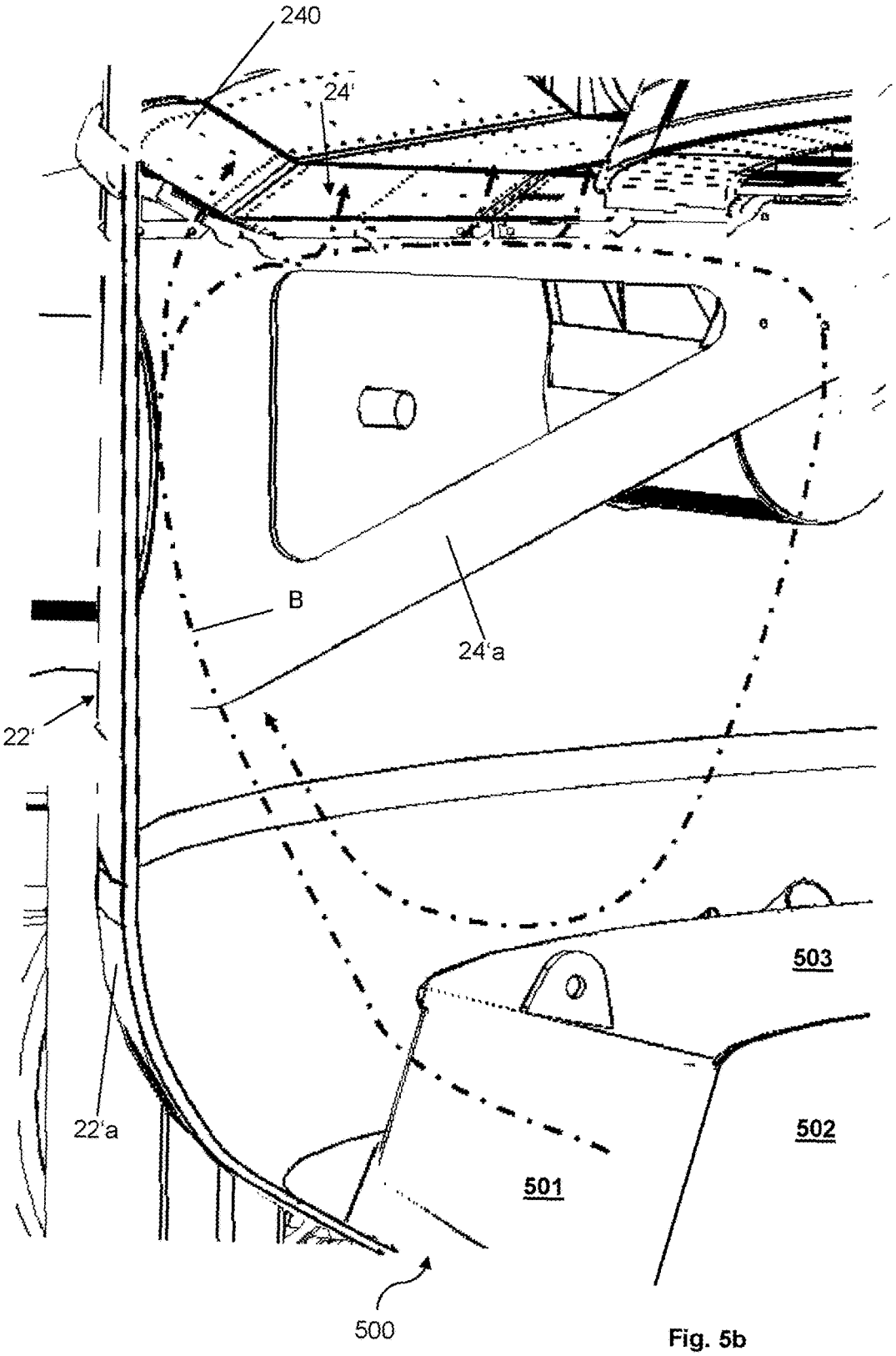
FIG. 5*b* shows a partial profile view of the floor area as shown in FIG. 5*a;*

FIG. 5*a* shows a top view onto a torospherical head 22'*a* of a second exemplary embodiment of a fluidised bed vaporisation dryer according to the invention, in which in addition to a bellows 7', a plurality of guide plates 501 of a discharge guide vane 500 are arranged, which serve to condition the flow in the torospherical head 22'*a*, namely to guide said flow radially outwards, as is shown by the flow paths A in FIG. 5*a*. The discharge guide vane 500 comprises additional guide plates 502 and 503 with different orientations, as is best shown in FIG. 5*b*, which shows a partial perspective of the area below an inflow floor 24' within a floor 22' with the torospherical head 22'*a*. The guide plates 501, 502, 503 may also be referred to as the first second flow guidance members 501, 502, 503. In FIG. 5*b*, an inflow floor supporting member 24'*a* is also shown here, along which the flow conditioned by the 500 rises according to the flow path B, and either through openings in the essentially horizontally running inflow floor 24' or in an edge 240' which is inclined towards the wall of the floor 22' also reaches the process chamber, or is circulated in the area of the floor 22' below the inflow floor 24'.

Figure 5C:
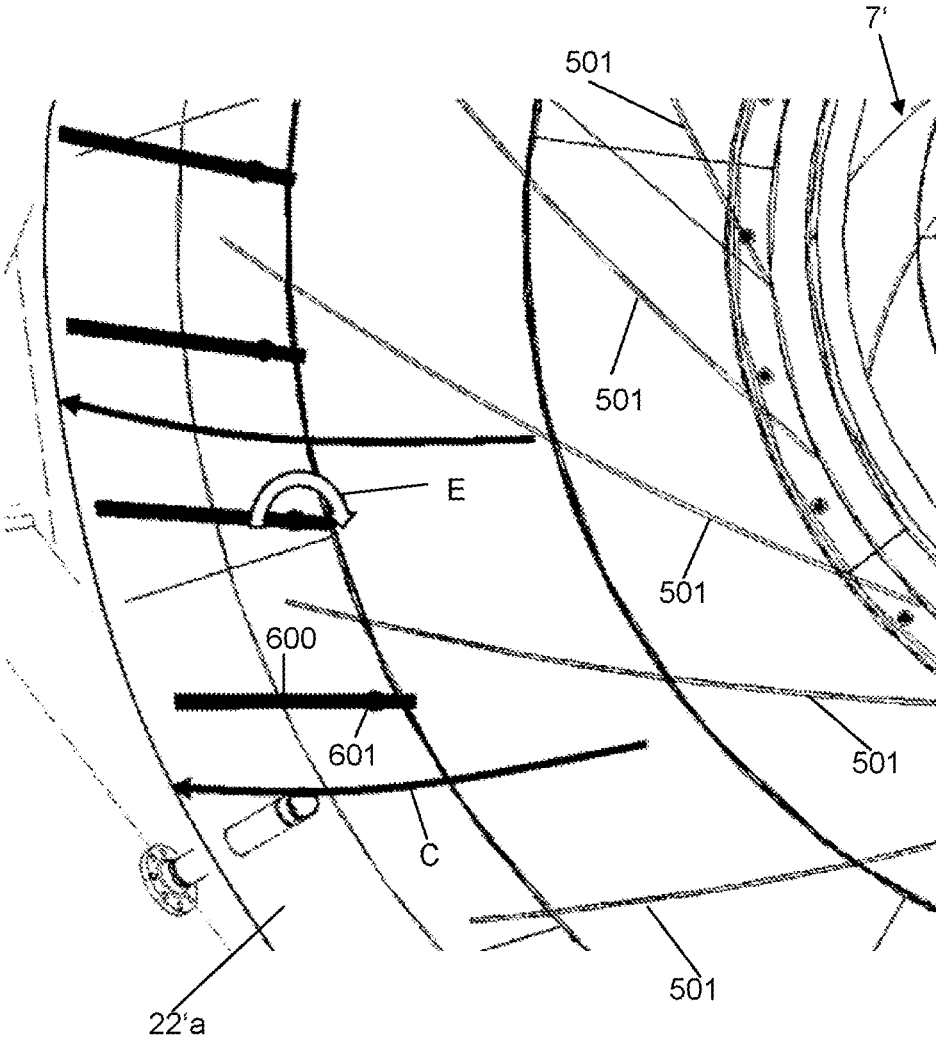
FIG. 5*c* shows a view as shown in FIG. 5*a* with additional, adjustable guide plates.
Figure 5D:
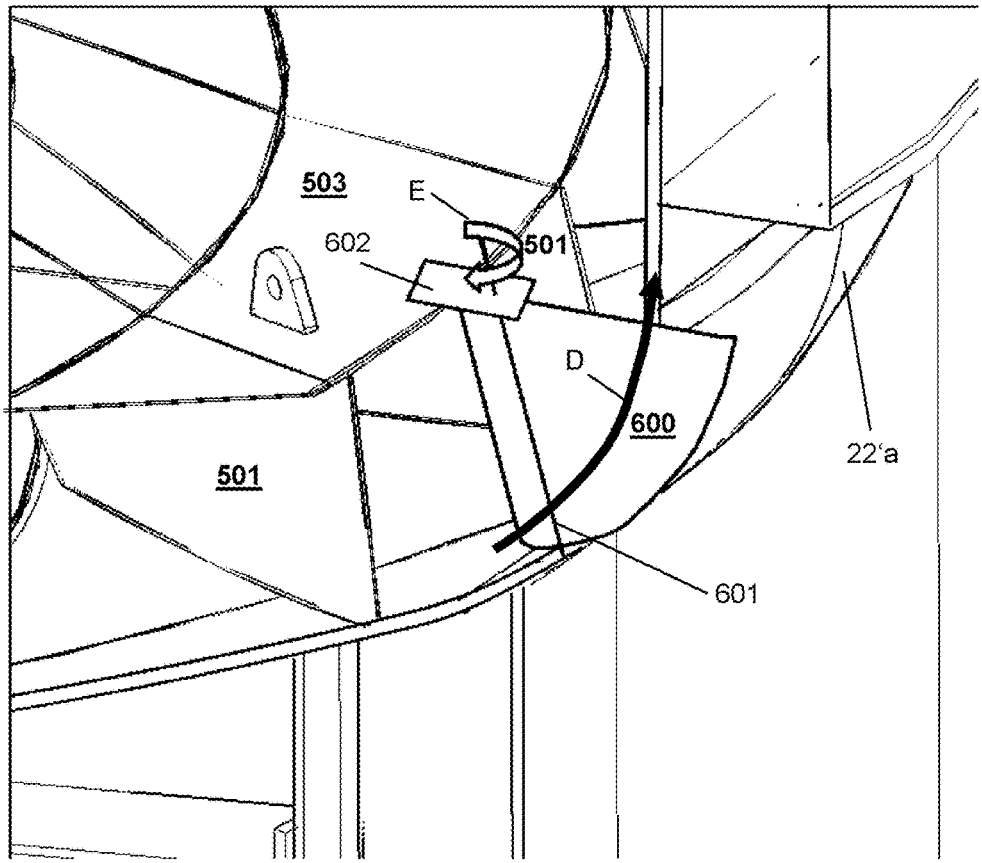
FIG. 5*d* shows a perspective partial view of the floor area as shown in FIG. 5*c;*

It was discovered in a surprising way that the swirl flow enforced by the discharge guide vane 500 below the inflow floor 24' in the process chamber has a considerable influence on the transportation of solid materials. In order to be able to influence this transportation of solid materials in a targeted manner, it is recommended according to the invention that adjustable guide plates 600 be provided in the area of the floor 22', in particular through into the torospherical head 22'*a*, as shown in FIGS. 5*c* and 5*d*. Each adjustable guide plate 600 is here pivotable around a pivot axis 601 via and adjustment installation 602. The adjustable guide plates 600 may also be referred to as the second flow guidance members 600. The adjustment installation 602 can be either manually adjusted in cases when the fluidised bed vaporization dryer according to the invention is opened, or also from outside the fluidised bed vaporization dryer, even when in drying mode.

Figure 6:
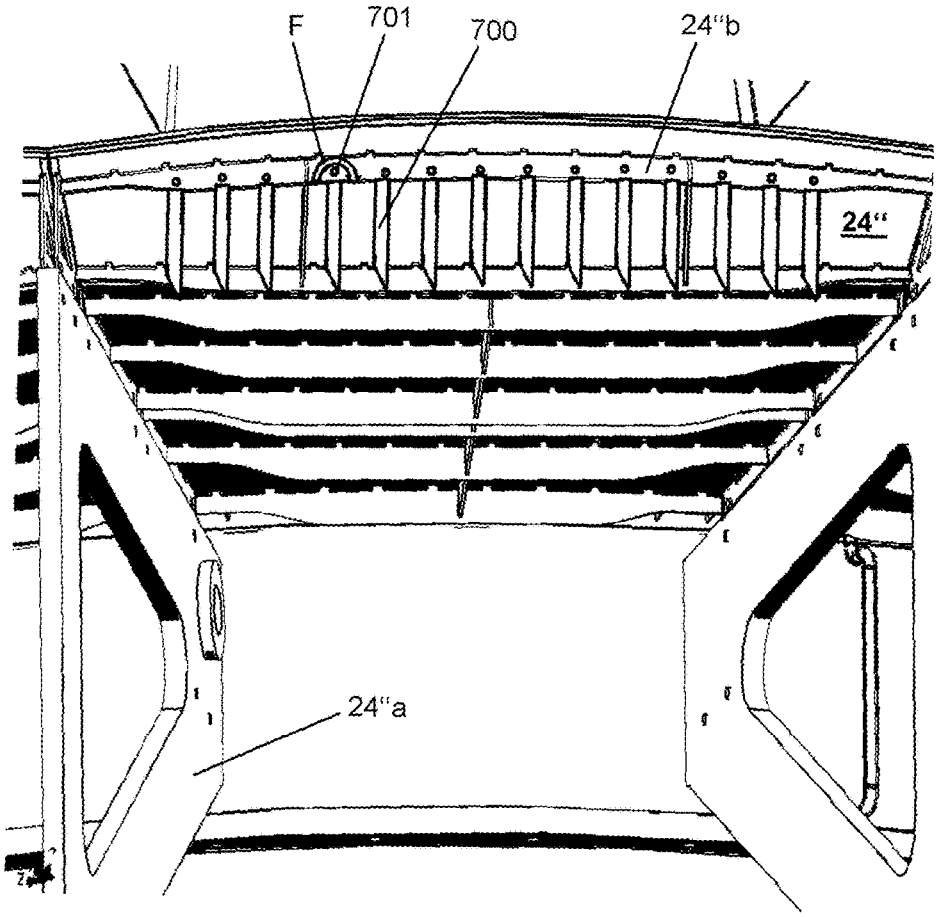
FIG. 6 shows a perspective view of the floor area of a third exemplary embodiment of the device according to the invention.

As an alternative to the adjustable guide plates 600, or even in addition to these, further adjustable guide plates 700 can be arranged directly below the inflow floor. This is shown in FIG. 6 in a perspective view, according to which the adjustable guide plates 700 in the area of the inflow floor supporting members 24"*b* are essentially arranged in parallel to the inflow floor 24", such that they are pivotable around a pivot axis 701, as is shown by the arrow F. The inflow floor supporting members 24"*b* are for their part supported by the inflow floor supporting members 24"*a*, which are affixed to the wall of the floor.

Figure 7A:
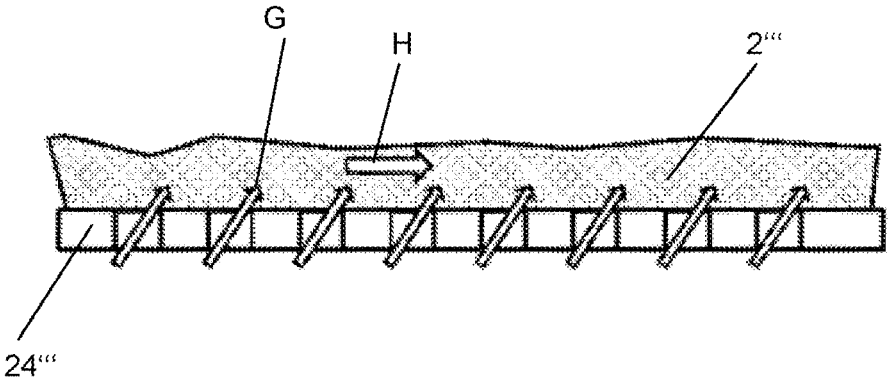
FIGS. 7*a* and 7*b* show profile views through an inflow floor of the device as shown in FIGS. 5*a*-5*d*.
Figure 7B:
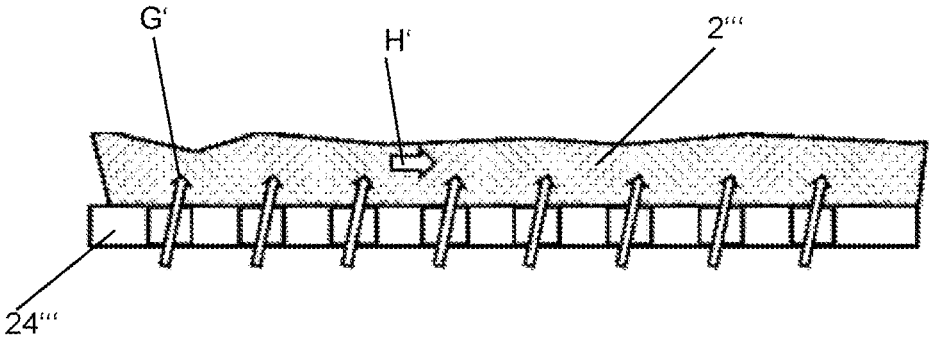

The method of functioning of the adjustable guide plates 600 and 700 will now be explained with reference to FIGS. 7*a* and 7*b*. In FIGS. 7*a* and 7*b*, the flow path G and G' can namely be seen through the individual openings in an inflow floor 24''', which has an influence on the solid materials transportation path H or H' within the fluidised bed 2'''. Depending on the orientation of the flow path G and G', different effects occur. Thus, a flow path G as shown in FIG. 7*a* leads to increased transportation within the fluidised bed 2''' due to its lesser inclination to the inflow floor 24''', while a flow path G' as shown in FIG. 7*b* penetrates the inflow floor 24''' more steeply, and thus ensures an increased swirl in the fluidised bed 2'''.

Naturally, the adjustable guide plates 600 and 700 can be combined with special perforated sheet designs, as well as guide plates above the inflow floor. Such a combination enables a precise adjustment of the flow required for the respective pulp for the purpose of optimising the drying from an inlet cell to an outlet cell.

The features disclosed in the above description, in the drawings and in the claims can be essential both individually and in any combination required for the realisation of the invention in its different embodiments.

LIST OF REFERENCE NUMERALS

1 Feeding installation
2, 2''' Fluidised bed
3 Discharge installation
4 Dust collector
5 Vapour outlet
6 Heater
7, 7' Bellows
21 Container
22, 22' Floor
22*a*, 22'*a* Torospherical head
23 Process chamber
24, 24', 24", 24''' Inflow floor
24'*a*, 24"*a*, 24"*b* Inflow floor supporting member

25 Wall
26 Extension cone
27 Upper area
28 Lid
29 Impeller
33 Dust cyclone
34 Nozzle
35 Nozzle
36 Rib
201 Inlet cell
202 Outlet cell
240' Edge
300 Apron
302 Nozzle
303 Guide plate
304*a* Perforated sheet
304*b* Perforated sheet
305 Perforated sheet
306 Transportation area
307 Edge
310-313 Flow line
341 Hole
342 Scale
343 Underside
344 Upper side
400 Screw conveyor
401 Paddle
402 Feed area
403-405 Vapour feed
406 Docking area
500 Discharge guide vane
501-503 Guide plate
600 Adjustable guide plate
601 Pivot axis
602 Adjustment installation
700 Adjustable guide plate
701 Pivot axis
1000 Fluidised bed vaporisation dryer
A Flow path
B Flow path
C Flow path
D Flow path
E Pivot direction
F Pivot direction
G. G' Flow path
H. H' Solid material flow path

The invention claimed is:

1. A device for removing fluids and/or solid substances from a mixture of particle-shaped materials, the device comprising:

a container, which forms a ring-shaped process chamber with a plurality of cells separated from each other by walls, comprising an inlet cell, intermediate cells and an outlet cell;

a feeding installation for entering the mixture to be treated into the inlet cell of the process chamber;

a discharge installation for discharging the treated mixture from the outlet cell of the process chamber;

a ventilation installation for adding a first fluidisation agent in the form of overheated vapor, from below into the process chamber through an inflow floor for generating a fluidised bed in the process chamber;

a heater for preparing the first fluidisation agent in the direction of flow in front of the ventilation installation;

swirl impellers for conditioning the flow in a container from the process chamber to the heater and in part to a vapor outlet; and a dust removal installation in the flow path between the process chamber and the heater, wherein via the dust removal installation (4) dust can be guided to the outlet cell, wherein the feeding installation for the mixture is connected to the container in the area of the inlet cell, and the feeding installation feeds a loosened mixture via a mechanical transportation by means of mechanically acting paddles comprising a screw conveyor, or pre-heated or via air transport, by applying it with a third fluidisation agent in the form of overheated vapor, through vapor injection into the screw conveyor, and wherein the area of the inflow floor is larger in the inlet cell than the respective area of the inflow floor of the intermediate cells and double the size.

2. The device of claim 1, wherein in order to support a transportation of the mixture from the inlet cell to the outlet cell or a turbulence of the mixture in the process chamber, the inflow floor comprises first unevenness, at least at times, a second fluidisation agent in the form of overheated vapor, can be fed at least into the inlet cell essentially parallel to the inflow floor by means of first nozzles, or first flow guidance members are provided above the inflow floor or second guidance members are provided below the inflow floor.

3. The device of claim 2, wherein in the inlet cell, a mixing of dried and damp parts of the mixture, in the intermediate cells, a flow guide is realized to avoid a mixing of damp parts with dried parts of the mixture, and no fluidisation agent reaches the outlet cell through the inflow floor.

4. The device of claim 1, wherein the feeding installation for the mixture is connected to the container in the center at the level of the inlet cell or at the level of upper extensions of the fluidised bed.

5. The device of claim 1, wherein the inflow floor comprises first openings in the inlet cell and the intermediate cells, the opening relationship of which decreases from the inlet cell in the direction of the outlet cell.

6. The device of claim 1, wherein the inflow floor comprises a first unevenness in the form of deeper lying recesses and/or at least over the first quarter of the process chamber.

7. The device of claim 1, wherein the inflow floor is inclined upwards on its edge facing towards the container, and otherwise runs essentially horizontally, wherein the edge is equipped with first openings or first unevenness, at least over the first quarter of the process chamber.

8. The device according to claim 1, wherein a second fluidisation agent can be fed in with a pressure of at least two bar above the average pressure in the container or in the first quarter of the process chamber.

9. The device of claim 1, further comprising a screen of the heater, wherein the screen expands conically upwards in the process chamber from bottom to top, first nozzles extend between the screen and the inflow floor, or the screen comprises second openings or second unevenness in the form of deeper lying recesses.

10. The device of claim 1, wherein the walls extend downwards between the outlet cell and the inlet cell through to the level of the inflow floor, or walls, between the inlet cell and a first intermediate cell, between the intermediate cells and between the last intermediate cell and the outlet cell comprise a vertical distance to the inflow floor, and to an edge of the inflow floor.

11. The device of claim 1, wherein first flow guidance members are provided or adjustable between first nozzles.

12. The device of claim 1, wherein first second flow guidance members are provided in a torospherical head as part of a discharge guide vane of the ventilation installation, and the ventilation installation comprises a bellows within the discharge guide vane.

13. The device of claim 1, wherein second second flow guidance members are provided in a torospherical head or on a discharge guide vane or are respectively pivotable around a pivot axis which essentially extends vertical to the inflow floor or vertically.

14. The device of claim 1, wherein third second flow guidance members are attached to inflow floor supporting members or are respectively pivotable around a pivot axis which essentially extends parallel to the inflow floor or horizontally.

15. The device of claim 1, wherein the number, alignment or arrangement of first or second openings, first or second unevenness, first nozzles, or first or second flow guidance members is or are determined or can be changed for a targeted application of horizontal transport impulses to the mixture in the direction of the outlet cell or vertical turbulence impulses.

16. The device of claim 15, wherein the alignment of the second second or third second flow guidance members, or the feed of a second fluidisation agent to the first nozzles via an adjustment installation which is operated from outside the container, is configured be changed.

* * * * *